US008118563B2

(12) United States Patent
Chen et al.

(10) Patent No.: US 8,118,563 B2
(45) Date of Patent: Feb. 21, 2012

(54) TANDEM COMPRESSOR SYSTEM AND METHOD

(75) Inventors: Jianxiong Chen, Greer, SC (US); Eric P. Cavender, Troy, OH (US); Bobby Kalloor, Huber Heights, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 868 days.

(21) Appl. No.: 12/139,670

(22) Filed: Jun. 16, 2008

(65) Prior Publication Data

US 2008/0317619 A1 Dec. 25, 2008

Related U.S. Application Data

(60) Provisional application No. 60/945,783, filed on Jun. 22, 2007.

(51) Int. Cl.
*F04B 41/06* (2006.01)

(52) U.S. Cl. ..... 417/3; 417/312; 62/510

(58) Field of Classification Search ..... 417/2, 3, 417/312; 62/470, 510
See application file for complete search history.

(56) References Cited

U.S. PATENT DOCUMENTS 2,239,723 A * 4/1941 Limpert et al. ..... 417/419
3,066,857 A * 12/1962 McCloy ..... 417/363
3,820,921 A * 6/1974 Thayer ..... 417/312
4,105,374 A * 8/1978 Scharf ..... 417/415
4,205,537 A * 6/1980 Dubberley ..... 62/510
4,277,955 A * 7/1981 Parker ..... 62/510
4,576,555 A * 3/1986 Ashenfelter ..... 417/372
5,277,554 A * 1/1994 Elson ..... 417/363
5,385,453 A * 1/1995 Fogt et al. ..... 417/410.5
6,928,828 B1 8/2005 Taras et al.
6,966,192 B2 11/2005 Lifson et al.
6,983,622 B2 * 1/2006 De Bernardi et al. ..... 62/468
6,993,932 B2 * 2/2006 Lee et al. ..... 62/470
7,213,406 B2 * 5/2007 Decourioux et al. ..... 62/295
2005/0106037 A1 * 5/2005 Kim et al. ..... 417/312

OTHER PUBLICATIONS

International Preliminary Report on Patentability dated Dec. 22, 2009 regarding International Application No. PCT/US2008/007631.

* cited by examiner

*Primary Examiner* — Devon C Kramer
*Assistant Examiner* — Peter J Bertheaud
(74) *Attorney, Agent, or Firm* — Harness, Dickey & Pierce, P.L..C.

(57) ABSTRACT

A compressor system including a first compressor and a second compressor. The first and second compressors each include a shell, a compression mechanism disposed within the shell, and a drive member adapted to drive the compression mechanism. A discharge tube assembly interconnects the first compressor and the second compressor, and the discharge tube assembly includes an inlet portion adjacent the first compressor that is inclined relative to another inlet portion adjacent the second compressor. The inlet portion that is inclined is adapted to prevent a backflow of oil through the discharge tube assembly.

13 Claims, 4 Drawing Sheets

TANDEM COMPRESSOR SYSTEM AND METHOD

FIELD

The present disclosure relates to a tandem compressor system and method.

BACKGROUND

The statements in this section merely provide background information related to the present disclosure and may not constitute prior art.

A tandem compressor system consists of two compressors. A discharge tube assembly connects the two compressors to the outside system. When only a single compressor is running, oil may enter the discharge tube assembly and flow back toward the non-running compressor. The presence of oil in the discharge tube near the non-running compressor adds mass to the discharge tube assembly and reduces tube modal frequencies, which, in turn, may lead to tube resonance problems and tube failures.

SUMMARY

The present teachings provide a compressor system comprising a first compressor and a second compressor. The first and second compressors may each include a shell, a compression mechanism disposed within the shell, and a drive member adapted to drive the compression mechanism. A discharge tube assembly including a first discharge tube and a second discharge tube may interconnect the first compressor and the second compressor, and a distal portion of the first discharge tube and a distal portion of the second discharge tube may be joined at a common discharge tube. A proximate portion of the first discharge tube may be elevated relative the distal portion of the first discharge tube.

The proximate portion may include a shock loop.

The proximate portion may be elevated relative to the distal portion to prevent a backflow of oil through the discharge tube assembly.

The proximate portion may be angled relative to the distal portion between 5 degrees and 10 degrees.

The proximate portion may be angled relative to the distal portion between 1 degree and 90 degrees.

The proximate portion may be elevated relative to the distal portion by at least one half a tube diameter.

A proximate portion of the second discharge tube may be elevated relative the distal portion of the second discharge tube.

The present teachings also provide a compressor system comprising a first compressor and a second compressor. The first and second compressors may each include a shell, a compression mechanism disposed within the shell, a drive member adapted to drive the compression mechanism, a suction inlet fitting, and a discharge fitting. A discharge tube assembly may extend from the discharge fittings including a first discharge tube and a second discharge tube interconnecting the first compressor and the second compressor. A distal portion of the first discharge tube and a distal portion of the second discharge tube may be joined at a common discharge tube, and a proximate portion of the first discharge tube may be elevated relative the discharge fitting of the first compressor.

The proximate portion may prevent a backflow of oil through the discharge tube assembly.

The proximate portion may be upwardly angled relative the distal portion

The proximate portion may be upwardly angled relative the distal portion between 5 degrees and 10 degrees.

The proximate portion may be upwardly angled relative the distal portion between 1 degree and 90 degrees.

The proximate portion may be elevated relative to the discharge fitting by at least one half a tube diameter.

A proximate portion of the second discharge tube may be elevated relative the distal portion of the second discharge tube.

The present teachings also provide a compressor system comprising a first compressor and a second compressor. The first and second compressors may each include a shell, a compression mechanism disposed within the shell, and a drive member adapted to drive the compression mechanism. The compression mechanism may include a first scroll member having a first spiral wrap, and a second scroll member having a second spiral wrap intermeshed with the first spiral wrap of the first scroll member. A discharge tube assembly including a first discharge tube and a second discharge tube may interconnect the first compressor and the second compressor. Distal portions of the first and second discharge tubes may be joined at a common discharge tube, and proximate portions of the first and second discharge tubes may be elevated relative the distal portions.

The proximate portions may prevent a backflow of oil through the discharge tube assembly.

The proximate portions may be upwardly angled relative the distal portions between 5 degrees and 10 degrees.

The proximate portion of the first discharge tube may be upwardly angled relative the distal portion of the first discharge tube between 1 degree and 90 degrees.

The proximate portions may be elevated relative to the distal portions by at least one half a tube diameter of the first and second discharge tubes.

Further areas of applicability will become apparent from the description provided herein. It should be understood that the description and specific examples are intended for purposes of illustration only and are not intended to limit the scope of the claims.

DRAWINGS

The drawings described herein are for illustration purposes only and are not intended to limit the present disclosure.

DETAILED DESCRIPTION

Figure 1:
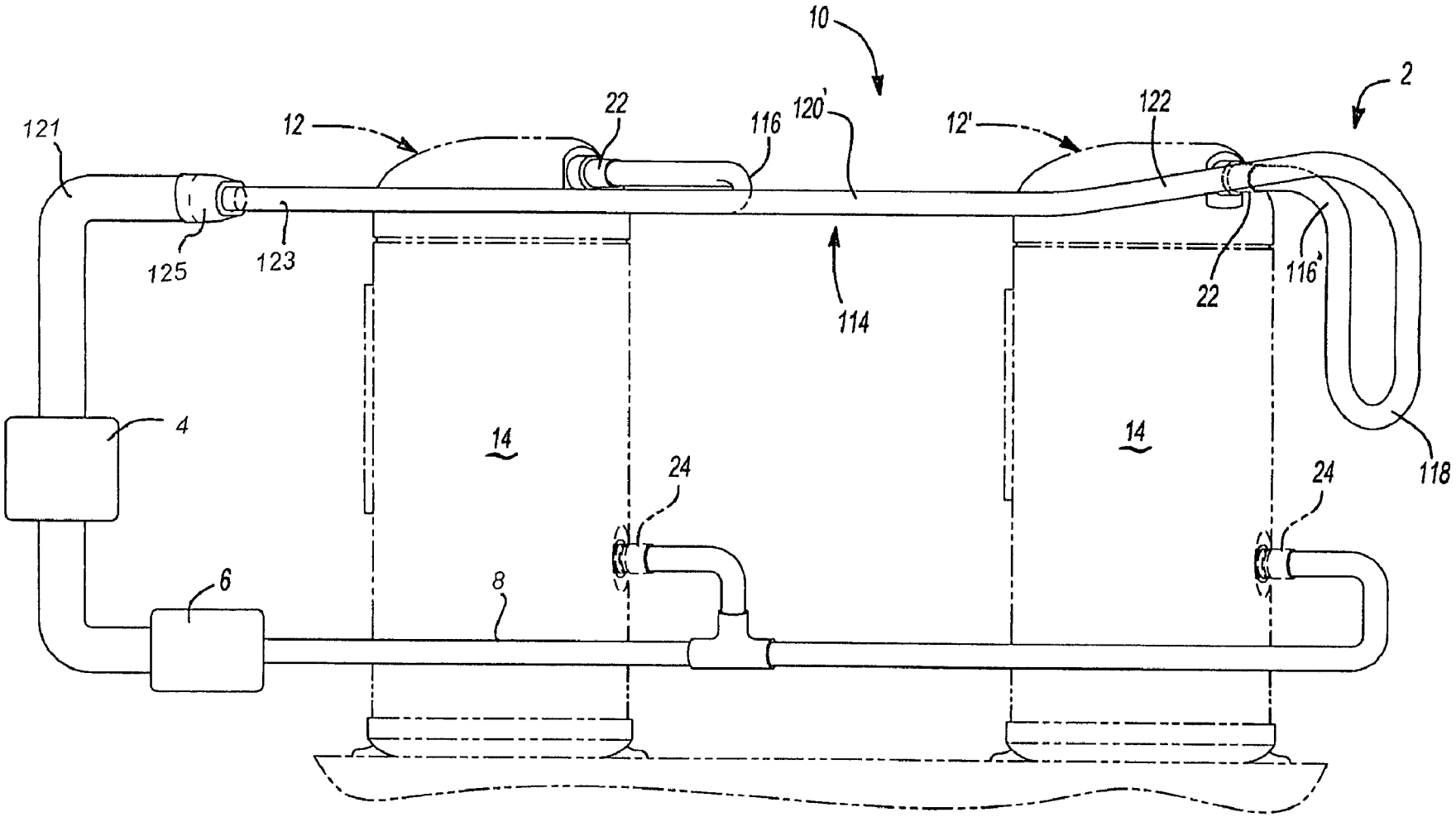
FIG. 1 is a perspective view of a tandem compressor system including a discharge tube assembly according to the present teachings.

The following description is merely exemplary in nature and is not intended to limit the present disclosure, application, or uses. It should be understood that throughout the drawings, corresponding reference numerals indicate like or corresponding parts and features.

Figure 2:
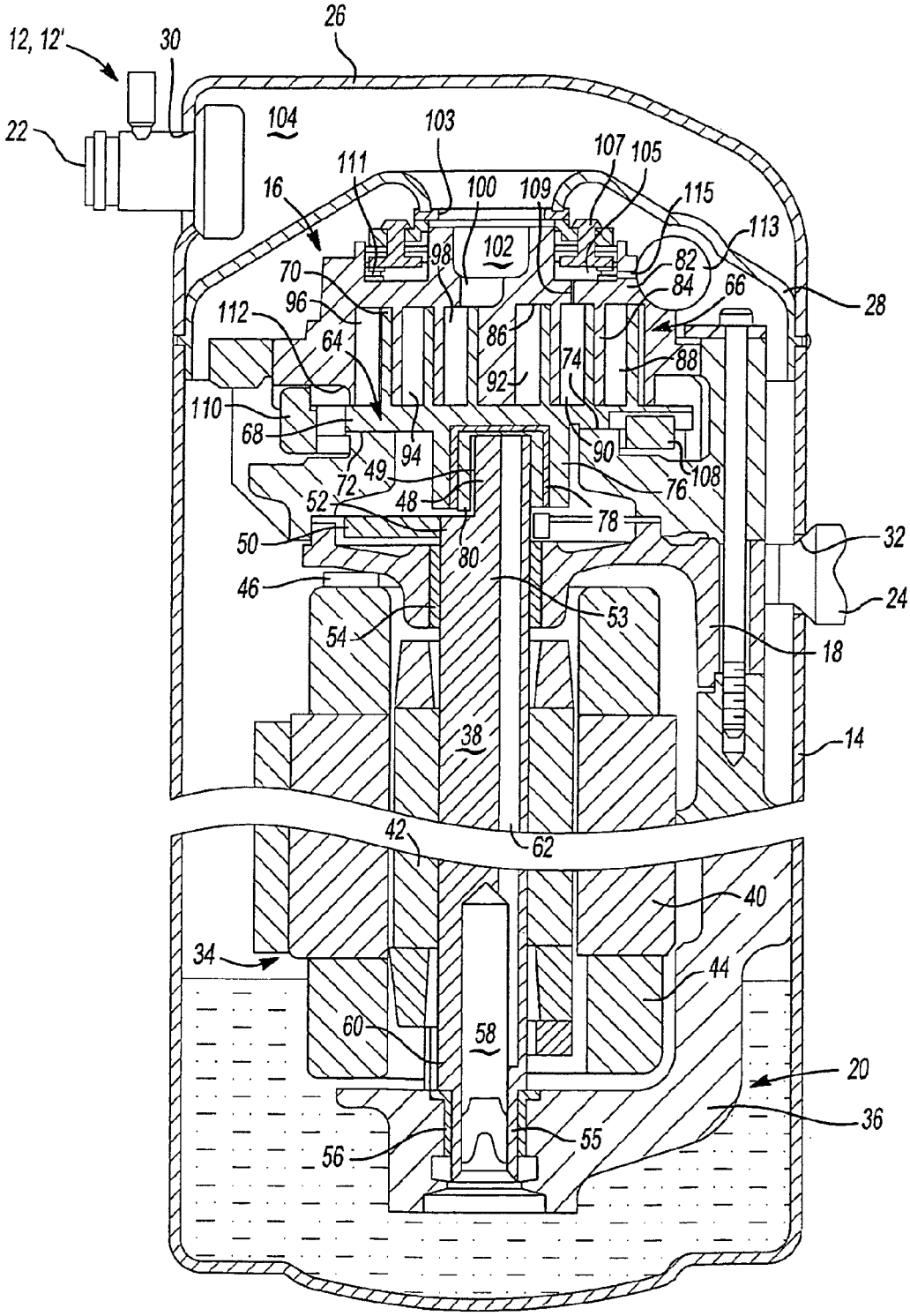
FIG. 2 is a cross-sectional view of an exemplary compressor used in the tandem compressor system.

Referring to FIG. 1, a compressor system 2 including a tandem compressor configuration 10 is shown. Compressor system 2 generally includes tandem configuration 10, a condenser 4, and an evaporator 6. Tandem configuration 10 includes a pair of compressors 12 and 12' that are adapted to operate either singularly or in combination. Each of compressors 12 and 12' may be a scroll compressor, as illustrated in FIGS. 1 and 2, or any other type of compressor known in the art. In this regard, the present teachings may be adapted to operate with any type of compressor known to one skilled in the art, including rotary, rotating, orbiting, and reciprocating types.

As shown in FIG. 2, compressors 12 and 12' may include a cylindrical hermetic shell 14, a compression mechanism 16, a main bearing housing 18, a motor assembly 20, a refrigerant discharge fitting 22, and a suction gas inlet fitting 24. Hermetic shell 14 may house compression mechanism 16, main bearing housing 18, and motor assembly 20. Shell 14 may include an end cap 26 at an upper end thereof and a transversely extending partition 28. Refrigerant discharge fitting 22 may be attached to shell 14 at an opening 30 in end cap 26. Suction gas inlet fitting 24 may be attached to shell 14 at an opening 32. Compression mechanism 16 may be driven by motor assembly 20 and supported by main bearing housing 18. Main bearing housing 18 may be affixed to shell 14 at a plurality of points in any desirable manner.

Motor assembly 20 may generally include a motor 34, a frame 36 and a drive member or drive shaft 38. Motor 34 may include a motor stator 40 and a rotor 42. Motor stator 40 may be press fit into frame 36, which may in turn be press fit into shell 14. Drive shaft 38 may be rotatably driven by stator 40. Windings 44 may pass through stator 40. Rotor 42 may be press fit on drive shaft 38. A motor protector 46 may be provided in close proximity to windings 44 so that motor protector 46 will de-energize motor 34 if windings 44 exceed their normal temperature range.

Drive shaft 38 may include an eccentric crank pin 48 having a flat 49 thereon and one or more counter-weights 50 at an upper end 52. Drive shaft 38 may include a first bearing portion 53 rotatably journaled in a first bearing 54 in main bearing housing 18 and a second bearing portion 55 rotatably journaled in a second bearing 56 in frame 36. Drive shaft 38 may include an oil-pumping concentric bore 58 at a lower end 60. Concentric bore 58 may communicate with a radially outwardly inclined and relatively smaller diameter bore 62 extending to the upper end 52 of drive shaft 38. The lower interior portion of shell 14 may be filled with lubricating oil. Concentric bore 58 may provide pump action in conjunction with bore 62 to distribute lubricating fluid to various portions of compressor 12 and 12'.

Compression mechanism 16 may generally include an orbiting scroll 64 and a non-orbiting scroll 66. Orbiting scroll 64 may include an end plate 68 having a spiral vane or wrap 70 on the upper surface thereof and an annular flat thrust surface 72 on a lower surface. Thrust surface 72 may interface with an annular flat thrust bearing surface 74 on an upper surface of main bearing housing 18. A cylindrical hub 76 may project downwardly from thrust surface 72 and may include a journal bearing 78 having a drive bushing 80 rotatively disposed therein. Drive bushing 80 may include an inner bore in which crank pin 48 is drivingly disposed. Crank pin flat 49 may drivingly engage a flat surface in a portion of the inner bore of drive bushing 80 to provide a radially compliant driving arrangement.

Non-orbiting scroll member 66 may include an end plate 82 having a non-orbiting spiral wrap 84 on lower surface 86 thereof. Non-orbiting spiral wrap 84 may form a meshing engagement with wrap 70 of orbiting scroll member 64, thereby creating an inlet pocket 88, intermediate pockets 90, 92, 94, 96, and outlet pocket 98. Non-orbiting scroll 66 may have a centrally disposed discharge passageway 100 in communication with outlet pocket 98 and upwardly open recess 102 which may be in fluid communication via an opening 103 in partition 28 with a discharge muffler chamber 104 defined by end cap 26 and partition 28.

Non-orbiting scroll member 66 has in the upper surface thereof an annular recess 105 having parallel coaxial side walls in which is sealingly disposed for relative axial movement an annular floating seal 107 which serves to isolate the bottom of recess 105 from the presence of gas under suction and discharge pressure so that it can be placed in fluid communication with a source of intermediate fluid pressure by means of a passageway 109. A spring 111 may urge floating seal 107 upward to maintain a sealing engagement. Non-orbiting scroll member 66 is thus axially biased against orbiting scroll member 64 by the forces created by discharge pressure acting on the central portion of scroll member 66 and those created by intermediate fluid pressure acting on the bottom of recess 105.

Compressor 12 and 12' may use a dual pressure balancing scheme to axially balance non-orbiting scroll member 66 with floating seal 107 being used to separate the discharge gas pressure from the suction gas pressure.

A solenoid valve 113 may be used to open and close a passageway 115 located within non-orbiting scroll 66. Passageway 115 extends from the bottom of recess 105 which is at intermediate pressure during operation of compressor 12 and 12' to the area of compressor 12 and 12' which contains suction gas at suction gas pressure.

Relative rotation of the scroll members 64 and 66 may be prevented by an Oldham coupling, which may generally include a ring 108 having a first pair of keys 110 (one of which is shown) slidably disposed in diametrically opposed slots 112 (one of which is shown) in non-orbiting scroll 66 and a second pair of keys (not shown) slidably disposed in diametrically opposed slots in orbiting scroll 64.

As stated earlier it should be understood that although the above scroll compressor 12 and 12' may be used for each compressor in the tandem compressor configuration 10, any type of scroll compressor may be used for the compressors 12 and 12' that is known to one skilled in the art. Moreover, although it is preferred that the same type of compressor be used for each compressor in tandem configuration 10, it is not out of the scope of the present teachings to use different types of scroll compressors for each of the compressors. Also, although the compressors 12 and 12' are shown to stand vertically in FIG. 1, the present teachings should not be limited thereto. The compressors 12 and 12', rather, may also be horizontally oriented so long as the backflow of oil through a discharge tube assembly is prevented, as described below.

Compressors 12 and 12' are connected by a refrigerant tube 8 that enables a refrigerant or fluid to pass between each of compressors 12 and 12'. In this manner, compressors 12 and 12', when operating in tandem, may operate with an increased output capacity. In accordance with the present teaching, compressors 12 and 12' also share a discharge tube assembly 114 that connects compressors 12 and '12, as well as connects compressors 12 and 12' to refrigerant system 2 including condenser 4 and evaporator 6. Discharge tube assembly 114 shared by the compressors 12 and 12' is shown, for example, in FIG. 1.

Figure 3:
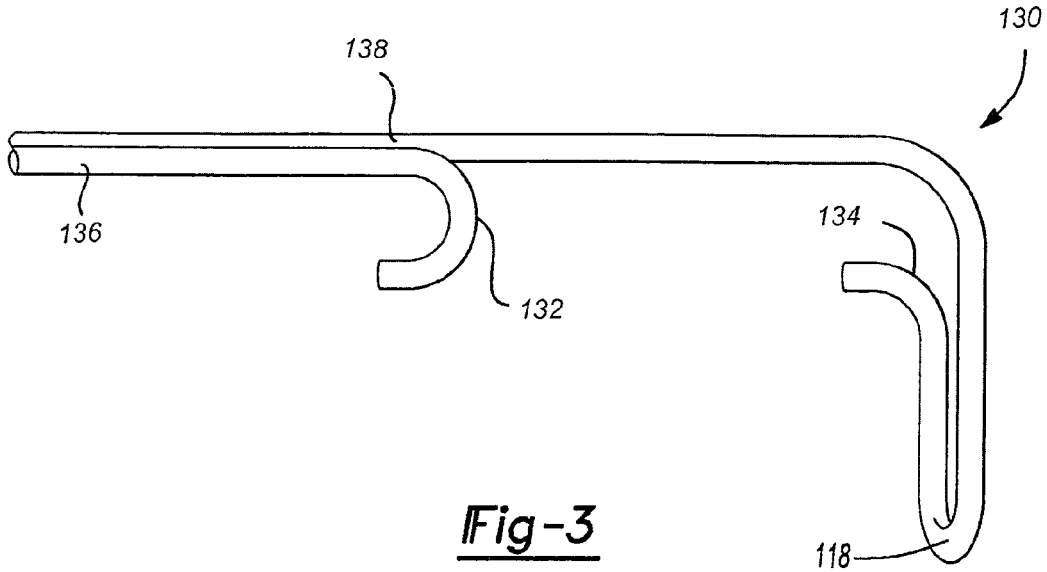
Fig-3 PRIOR ART
FIG. 3 is a perspective view of a prior art discharge tube assembly.
Figure 4:
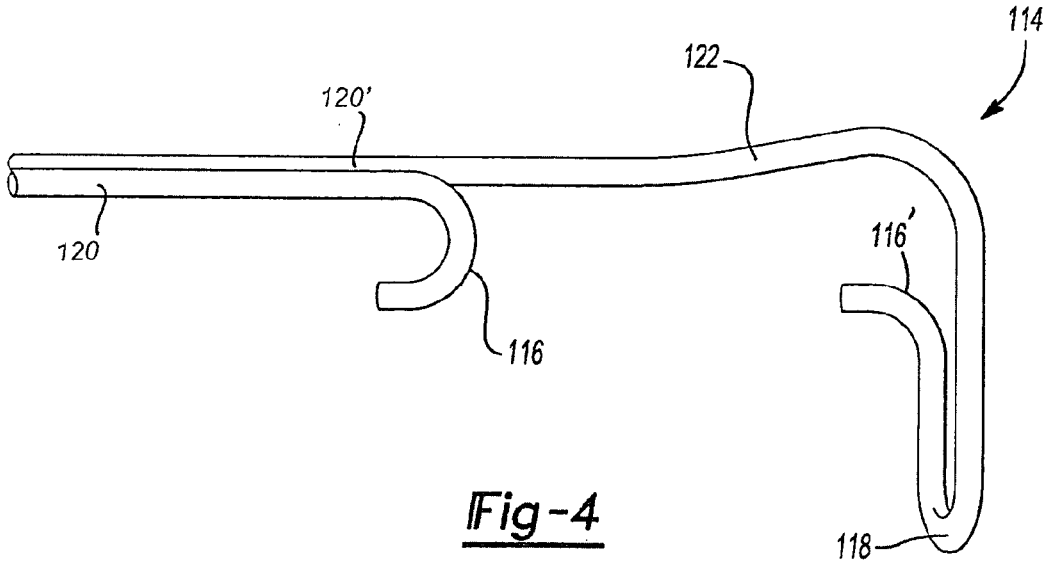
FIG. 4 is a perspective view of a discharge tube assembly according to the present teachings.

With particular reference to FIGS. 3 and 4, discharge tube assembly 114 includes a pair of proximate portions 116 and 116' that are connected to outlet fittings 22 of compressors 12 and 12'. Proximate portion 116' connected to compressor 12' may include a shock loop 118, which may be used to reduce stress in discharge tube assembly 114 during start/stop and running conditions by changing a stiffness of the discharge tube assembly 114 and its resonant frequencies. After shock loop 118, proximate portions 116 and 116' of compressors 12 and 12' connect to elongated tubes 120 and 120'. Elongated tubes 120 and 120' connect to a common discharge tube 121 at distal ends 123 thereof via a fitting 125 (FIG. 1). Common discharge tube 121 connects compressors 12 and 12' to the rest of compressor system 2, which includes condenser 4 and evaporator 6.

FIG. 3 shows a conventional discharge tube assembly 130 including a shock loop 118. As shown in FIG. 3, after shock loop 118, proximate portions 132 and 134 of compressors 12 and 12' each connect to elongated tubes 136 and 138 that are substantially straight and horizontal. When only compressor 12 of the tandem configuration 10 is running, oil may pass through the proximate portion 132, enter elongated tube 136, and subsequently enter common discharge tube 121. Because elongated tubes 136 and 138 are substantially straight and horizontal, the oil that has entered common discharge tube 121 may flow back towards and reenter elongated tubes 136 and 138. If oil enters elongated tube 138, oil may subsequently accumulate in shock loop 118 of proximate portion 134 adjacent compressor 12'. Any oil that accumulates in shock loop 118 may add unnecessary mass to discharge tube assembly 130 and may reduce the modal frequencies of discharge tube assembly 130. The reduced modal frequencies may lead to resonant problems of the discharge tube assembly 130, which in turn may lead to the assembly 130 failing. That is, discharge tube assembly 130 may break off from outlet fittings 22 of compressors 12 and 12'.

Discharge tube assembly 114 shown in FIG. 4 may be provided with an inclined portion 122, which prevents, or at least minimizes, any oil that may accumulate in elongated tube 120' from flowing into shock loop 118. Inclined portion 122 elevates proximate portion 116' relative to distal portion 123 of elongated tube 120' and discharge fitting 22, and requires any oil present in the elongated tube 120' to flow upwards through inclined portion 122 before it can reach shock loop 118. Due to gravity, the oil is prevented from flowing through inclined portion 122 into shock loop 118. Modal frequencies of discharge tube assembly 114, therefore, may be controlled and failure of discharge tube assembly 114 may be prevented.

Inclined portion 122 may be angled upward relative elongated tube 120' by an angle between 5 degrees and 10 degrees relative horizontal. Inclined portion 122 may be formed by bending discharge tube assembly 114 at a point adjacent shock loop 118, which may reduce manufacturing time and cost. Notwithstanding, any angle of inclination between about 1 degree and 90 degrees relative horizontal may be used.

Figure 5:
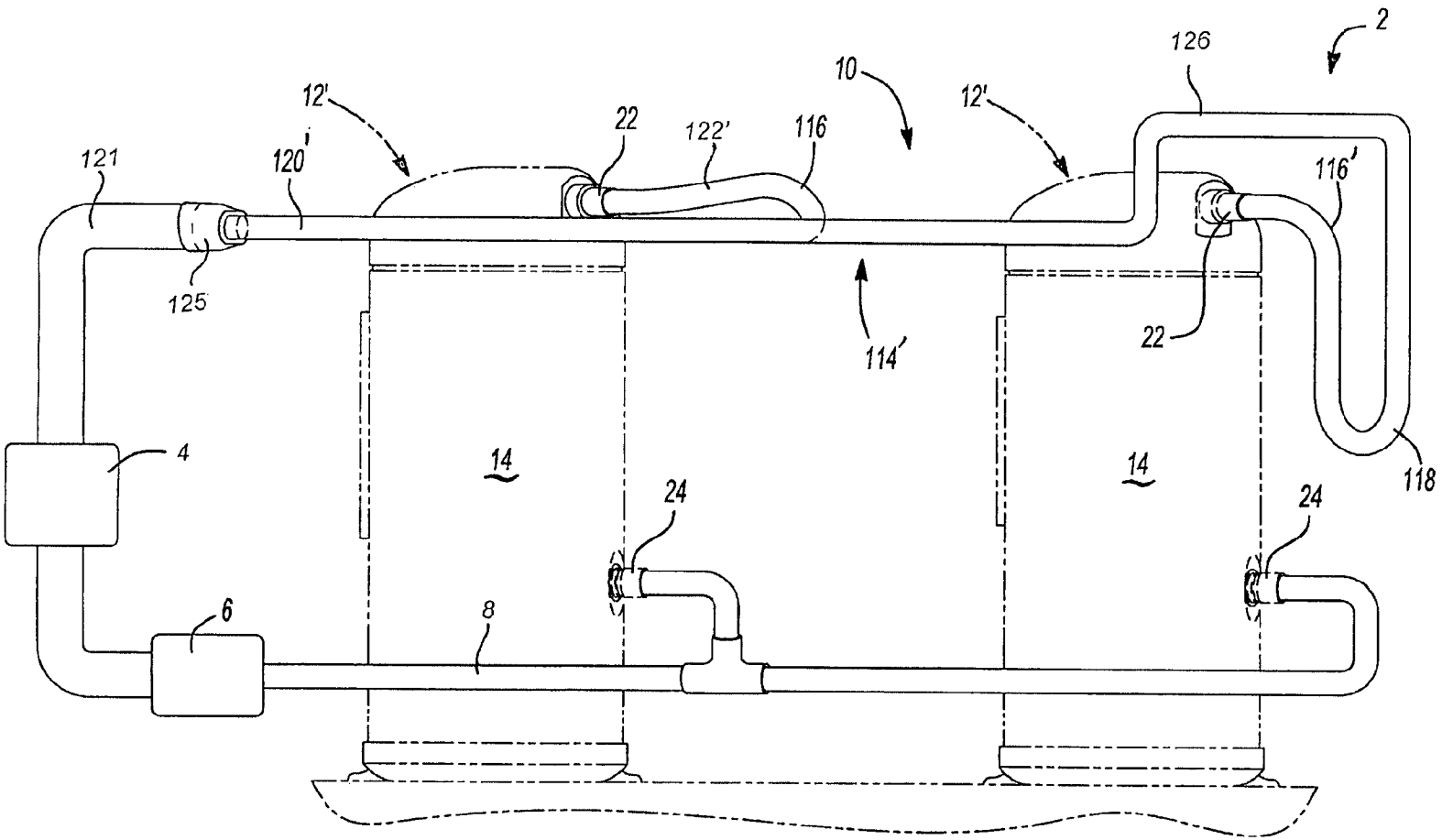
FIG. 5 is a perspective view of a tandem compressor system including a discharge tube assembly according to the present teachings.

Discharge tube assembly 114' in FIG. 5 has an inclined portion 126 inclined approximately 80 degrees to 90 degrees relative to horizontal tube 120'. Inclined portion 126 may also be elevated relative to horizontal tube 120' and discharge fitting 22 by a distance that may range between half a diameter of tube 120' and a diameter of tube 120'. In other words, the distance between inclined portion 126 and elongated tube 120' may range between a half diameter of tube 120' and a full diameter of tube 120'. Regardless, inclined portion 126 may be elevated relative to elongated tube 120' that is sufficient to prevent backflow of oil.

Furthermore, it should be understood that although the present teachings have been described relative to a discharge tube assembly 114 including shock loop 118, the present teachings should not be limited thereto. That is, discharge tube assembly 114 does not require use of shock loop 118 and may be formed to have an inclined portion 122 formed near proximate portion 116' of discharge tube assembly 114 adjacent outlet fitting 22 of the compressor 12'. Moreover, each compressor 12 and 12' may include a proximate portion 116 and 116' that includes an inclined portion 122 and 122' relative to horizontal tube 120.

The description of the present teachings is merely exemplary in nature and, thus, variations that do not depart from the gist of the present teachings are intended to be within the scope of the present teachings. Such variations are not to be regarded as a departure from the spirit and scope of the present teachings.

What is claimed is:

1. A compressor system comprising:

a first compressor and a second compressor, said first and second compressors each including a shell, a compression mechanism disposed within said shell, and a drive member adapted to drive said compression mechanism; and a discharge tube assembly including a first discharge tube and a second discharge tube interconnecting said first compressor and said second compressor, a distal portion of said first discharge tube and a distal portion of said second discharge tube being joined at a common discharge tube, said first discharge tube including a shock loop, and an intermediate portion of said first discharge tube located between said shock loop and said distal portion of said first discharge tube being elevated relative said distal portion of said first discharge tube.

2. The compressor system of claim 1, wherein said intermediate portion being elevated relative to said distal portion prevents a backflow of oil through said first discharge tube to said shock loop.

3. The compressor system of claim 1, wherein said intermediate portion is angled relative to said distal portion between 5 degrees and 10 degrees.

4. The compressor of claim 1, wherein said intermediate portion is angled relative to said distal portion between 1 degree and 90 degrees.

5. The compressor system of claim 1, wherein said intermediate portion is elevated relative to said distal portion by at least one half a tube diameter.

6. The compressor of claim 1, wherein a proximate portion of said second discharge tube is elevated relative said distal portion of said second discharge tube.

7. A compressor system comprising:

a first compressor and a second compressor, said first and second compressors each including a shell, a compression mechanism disposed within said shell, a drive member adapted to drive said compression mechanism, a suction inlet fitting, and a discharge fitting; and a discharge tube assembly extending from said discharge fittings including a first discharge tube and a second discharge tube interconnecting said first compressor and said second compressor, a distal portion of said first discharge tube and a distal portion of said second discharge tube being joined at a common discharge tube, said first discharge tube including a shock loop, and an intermediate portion of said first discharge tube located between said shock loop and said distal portion of said first discharge tube being elevated relative said discharge fitting of said first compressor.

8. The compressor system of claim 7, wherein said intermediate portion prevents a backflow of oil through said first discharge tube to said shock loop.

9. The compressor system of claim 7, wherein said intermediate portion is upwardly angled relative said distal portion of said first discharge tube.

10. The compressor system of claim 9, wherein said intermediate portion is upwardly angled relative said distal portion of said first discharge tube between 5 degrees and 10 degrees.

11. The compressor system of claim 9, wherein said intermediate portion is upwardly angled relative said distal portion of said first discharge tube between 1 degree and 90 degrees.

12. The compressor system of claim 7, wherein said intermediate portion is elevated relative to said discharge fitting by at least one half a tube diameter.

13. The compressor of claim 7, wherein a proximate portion of said second discharge tube is elevated relative said distal portion of said second discharge tube.

* * * * *

UNITED STATES PATENT AND TRADEMARK OFFICE

CERTIFICATE OF CORRECTION

PATENT NO. : 8,118,563 B2
APPLICATION NO. : 12/139670
DATED : February 21, 2012
INVENTOR(S) : Jianxiong Chen et al.

It is certified that error appears in the above-identified patent and that said Letters Patent is hereby corrected as shown below:

| | |
|---|---|
| Column 2, Line 2 | After “distal portion” insert --.--. |
| Column 4, Line 60 | “'12” should be --12'--. |

Signed and Sealed this
Twenty-sixth Day of June, 2012

David J. Kappos

David J. Kappos
*Director of the United States Patent and Trademark Office*